US006308901B1

(12) United States Patent
Nitkiewicz et al.

(10) Patent No.: US 6,308,901 B1
(45) Date of Patent: Oct. 30, 2001

(54) FUEL INJECTOR WITH A CONE SHAPED BENT SPRAY

(75) Inventors: James Anthony Nitkiewicz, Hampton; James Paul Fochtman, Williamsburg, both of VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/500,232

(22) Filed: Feb. 8, 2000

(51) Int. Cl.[7] ..... F02M 61/20; F02M 51/00

(52) U.S. Cl. ..... 239/533.9; 239/533.2; 239/596; 239/391

(58) Field of Search ..... 239/533.2, 533.3, 239/533.9, 533.12, 596–598, 391, 390

(56) References Cited

U.S. PATENT DOCUMENTS

| | | | |
|---|---|---|---|
| 4,284,043 | 8/1981 | Happel | 123/299 |
| 4,467,966 | 8/1984 | Mueller | 239/533.4 |
| 4,531,678 | 7/1985 | Knapp | 239/533.3 |
| 4,650,122 | 3/1987 | Kienzle et al. | 239/497 |
| 4,915,350 | 4/1990 | Babitzka et al. | 251/129.15 |
| 4,979,479 | 12/1990 | Furukawa | 123/472 |
| 5,328,102 | 7/1994 | Babitzka et al. | 239/585.4 |
| 5,351,398 | 10/1994 | Haxell | 29/890.142 |
| 5,878,962 * | 3/1999 | Shen et al. | 239/533.9 |
| 6,019,296 | 2/2000 | Yamamoto et al. | 239/533.2 |
| 6,047,905 * | 4/2000 | Honda et al. | 239/533.2 |
| 6,092,743 * | 7/2000 | Shibata et al. | 239/533.12 |

FOREIGN PATENT DOCUMENTS

| | | |
|---|---|---|
| 7-119584-A * | 5/1995 | (JP) . |
| 8-296531-A * | 11/1996 | (JP) . |

* cited by examiner

*Primary Examiner*—Lesley D. Morris

(57) ABSTRACT

An injector for high pressure direct fuel injection in an internal combustion engine is disclosed. The injector has a downstream end and a longitudinal axis extending therethrough. The injector has an outlet orifice located at the downstream end. The outlet orifice has an outlet axis oblique to the longitudinal axis. The outlet orifice discharges a circular cone-shaped spray having a spray axis co-linear with the outlet axis. A method of forming a bent circular cone-shaped spray pattern is also disclosed.

22 Claims, 3 Drawing Sheets

FUEL INJECTOR WITH A CONE SHAPED BENT SPRAY

FIELD OF THE INVENTION

The present invention relates to fuel injectors, specifically, fuel injectors which spray fuel in a cone-shaped spray at a bent angle to a longitudinal axis of the fuel injector.

BACKGROUND OF INVENTION

Prior art fuel injectors include a discharge end which sprays fuel at an angle oblique to a longitudinal axis of the injector. One design includes a discharge channel which extends along the longitudinal axis, but has a discharge end face which is oblique to the longitudinal axis. This design produces a spray pattern which sprays fuel at an angle oblique to the longitudinal axis of the injector, but is elliptical in shape.

It is believed that another design of fuel injectors includes a discharge channel which is at an angle oblique to the longitudinal axis and has a discharge face which is generally perpendicular to the discharge channel. The discharge face includes a circular exit orifice for discharging the fuel. However, the fuel can be discharged only at the angle of the discharge channel relative to the longitudinal axis. If a user requires a different spray angle, a different injector having the discharge channel at the different spray angle must be used, requiring a significant amount of tooling.

It would be desirable to have a fuel injector which discharges fuel at an angle oblique to the longitudinal axis of the injector, but discharges a circular spray of fuel from the injector, and can be manufactured to discharge the circular spray at one of a variety of desired angles.

SUMMARY OF THE INVENTION

Briefly, the present invention discloses an injector having a downstream end and a longitudinal axis extending therethrough. The injector comprising an outlet orifice located at the downstream end. The outlet orifice has an outlet axis oblique to the longitudinal axis. The outlet orifice discharges a cone-shaped spray having a spray axis co-linear with the outlet axis.

The present invention is also a valve seat for a fuel injector. The fuel injector comprises a longitudinal injector axis extending therethrough. The fuel injector also includes an upstream end having a fuel entrance orifice on the longitudinal injector axis and a downstream end having a fuel exit orifice. The fuel injector also includes a channel extending between the fuel entrance orifice and the fuel exit orifice. The fuel exit orifice has a channel axis oblique to the longitudinal injector axis. Fuel exiting the fuel exit orifice forms a symmetrical cone-shaped spray having a spray axis co-linear with the channel axis.

Further, the invention is a valve seat assembly for a fuel injector. The valve seat assembly comprises a valve seat and a bent stream insert. The valve seat includes a longitudinal axis extending therethrough, an upstream end having a seat entrance orifice on the longitudinal axis, and a downstream end having a seat exit orifice on the longitudinal axis. The valve seat also includes a seat channel extending between the seat entrance orifice and the seat exit orifice along the longitudinal axis and a recessed opening downstream of the seat exit orifice along the longitudinal axis. The recessed opening is larger than the seat exit orifice. The bent stream insert includes an upstream insert end having an insert entrance orifice, a downstream insert end, and a channel axis extending therethrough. The bent stream insert also includes an insert channel having an insert exit orifice at the downstream insert end, the outlet orifice having a channel axis oblique to the longitudinal injector axis and an insert projection extending from the upstream end. The insert projection is adapted to be retained in the recessed opening. The seat exit orifice is in fluid communication with the insert entrance orifice. The channel axis is at a first angle oblique to the seat axis.

The present invention is also a method of generating a cone-shaped bent spray from a fuel injector. The method comprises the steps of directing fuel into an entrance orifice in a valve seat, the entrance orifice being along a longitudinal axis of the fuel injector; directing the fuel from the entrance orifice, through a channel in the valve seat, and to an exit orifice, the channel being along a channel axis at an angle oblique to the longitudinal axis; and discharging the fuel from the exit orifice, the fuel forming a coneshaped spray having a spray axis co-linear with the channel axis.

Additionally, the present invention is a method of changing a fuel spray angle in a fuel injector comprising the step of substituting the first bent stream insert from a discharge end of a fuel injector, the first bent stream insert having a first spray angle, for a second bent stream insert into the discharge end of the fuel injector, the second bent stream insert having a second spray angle.

Further, the present invention is a method of providing multiple bent sprays from a single injector assembly comprising the steps of providing an injector having a discharge end, the discharge end being adapted to receive one of a plurality of inserts, each insert having a different predetermined angle of discharge; selecting an insert with a pre-determined angle of discharge; and fixedly inserting the insert into the discharge end of the injector.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain features of the invention. In the drawings.

DETAILED DESCRIPTION OF THE PREFERRED EMBODIMENTS

Figure 1:
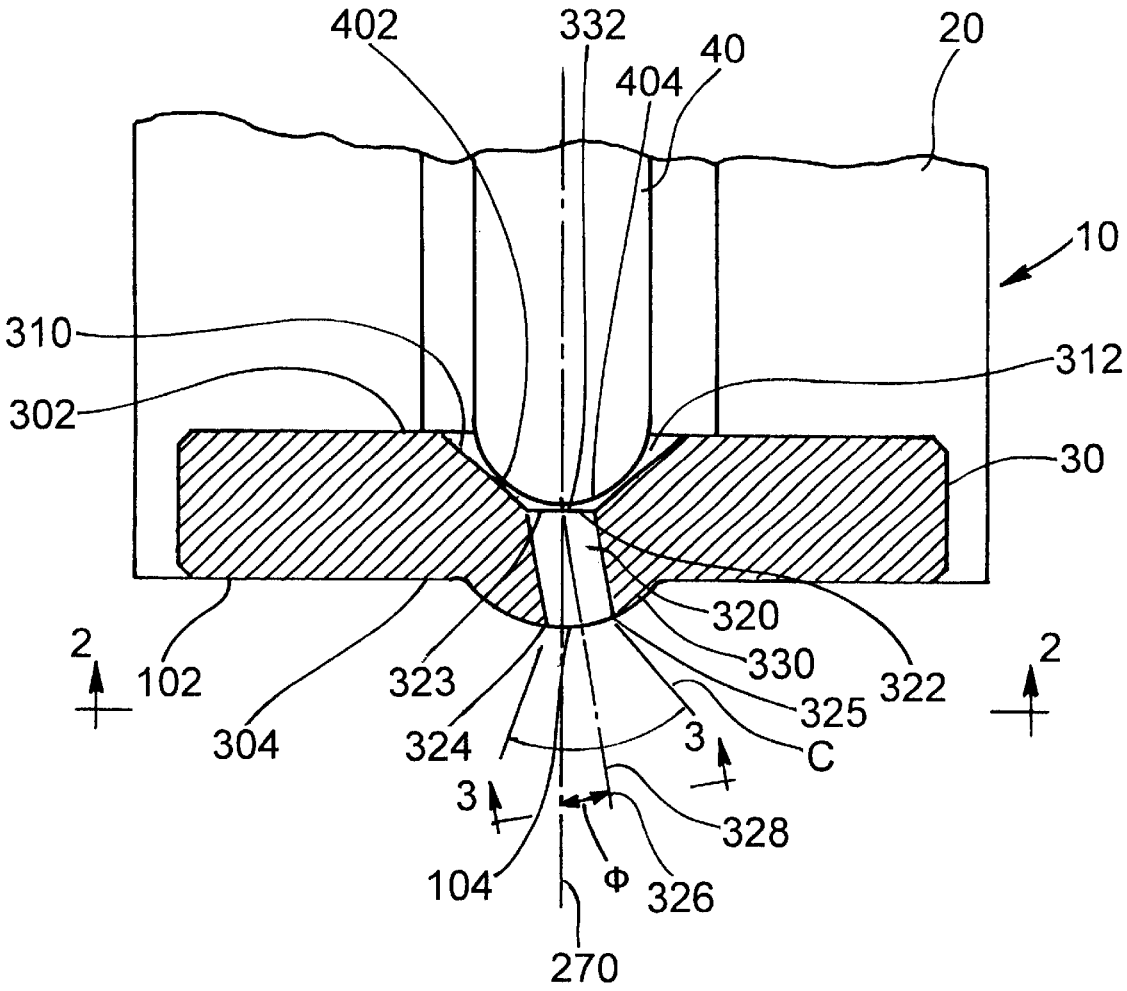
FIG. 1 is a side view, in section, of a fuel injector with a valve seat according to a first embodiment of the present invention.

A fuel injector 10 to which the present invention can be applied is disclosed by U.S. Pat. No. 5,875,972, which is owned by the assignee of the present invention and is incorporated herein by reference. In the drawings, like numerals are used to indicate like elements throughout. Referring to FIG. 1, the fuel injector 10 has a downstream end 102 and includes a housing 20 having a longitudinal axis 270 extending therethrough, a valve seat 30, and a needle 40. The injector 10 includes an outlet orifice or opening, generally indicated as 104, located at the downstream end 102.

A first embodiment of the present invention is shown in FIG. 1. The valve seat 30 of the injector 10 includes an upstream end 302, a downstream end 304, and a beveled surface 310 for seating a sealing surface 402 on a downstream end 404 of the needle 40. The beveled surface 310 also forms a transition cone 312, centered around the longitudinal axis 270, which directs fuel into a channel 320 which extends from the transition cone 312 to the downstream end 304. An upstream end 322 of the channel 320 has a generally circular fuel entrance orifice 323 and is generally concentrically aligned with the transition cone 312 and the longitudinal axis 270. The positioning of the upstream end 322 of the channel 320 with the longitudinal axis 270 provides for a round entrance to the channel 320 and helps to maintain a constant tangential velocity from a swirl disc (not shown).

A downstream end 324 of the channel 320 has a generally circular fuel exit orifice 325. Preferably, the fuel exit orifice 325 is the same as the outlet orifice 104, although those skilled in the art will recognize that the outlet orifice 104 can be located in another element of the fuel injector 10, such as a metering orifice (not shown). The downstream end 324 is offset from the longitudinal axis 270, forming the channel 320 at an angle Φ generally oblique to the longitudinal axis 270. As shown in FIG. 1, the channel 320 has a longitudinal channel axis 326 at an angle of approximately 10° oblique to the longitudinal axis 270, although those skilled in the art will recognize that the channel axis 326 can be at an angle of less than 10° or up to 30° with respect to the longitudinal axis 270. The ability to select different angles allows for greater flexibility for different applications.

Figure 2:
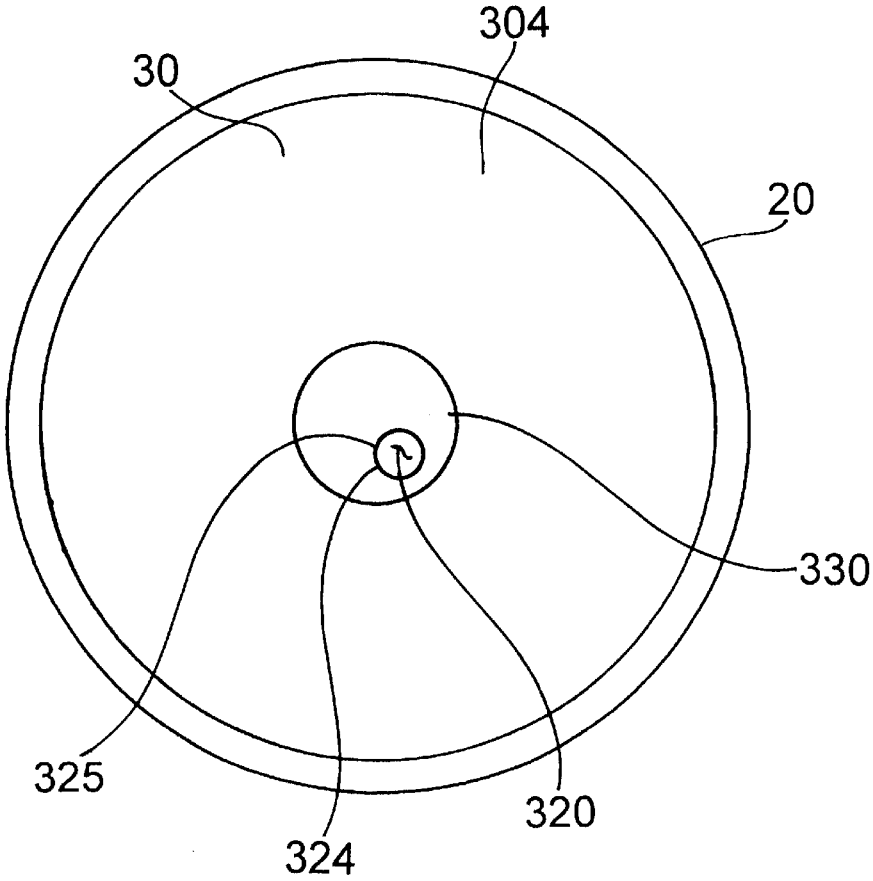
FIG. 2 is a bottom plan view of the valve seat taken along line 2—2 of FIG. 1.
Figure 3:
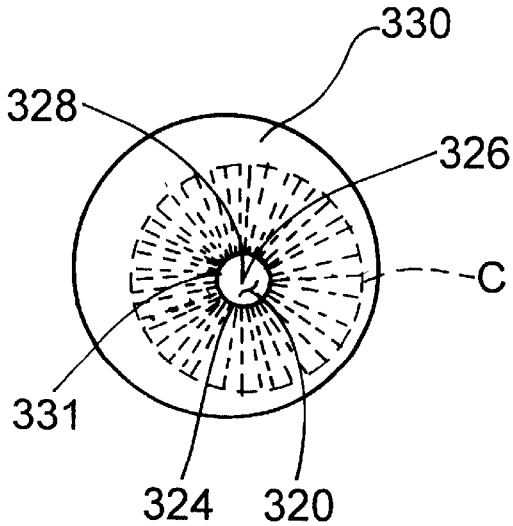
FIG. 3 is a bottom plan view of the fuel spray pattern taken along line 3—3 of FIG. 1.

The downstream end 304 of the valve seat 30 includes a generally spherical surface or projection 330. The fuel exit orifice 325 is located on the spherical projection 330. As shown in FIG. 2, the spherical projection 330 allows for a round fuel exit orifice 325 with a sharp edge at the downstream end 324 of the channel 320. The sharp edge at the exit orifice 325 maximizes flow turbulence at the exit orifice 325 and maintains a symmetrical cone-shaped spray. The sharp edge also provides an added benefit of reducing build up of deposits at the exit orifice 325. Fuel exiting from the fuel exit orifice 325 at the downstream end 324 forms a generally symmetrical right circular cone C, which exits the valve seat 30 at along a cone axis 328 which is generally co-linear with the channel axis 326, as shown in FIGS. 1 and 3.

Preferably, the valve seat 30 is constructed from 440C hardened stainless steel, although those skilled in the art will recognize that the valve seat 30 can be constructed of other, similar materials. The valve seat 30 can be heat treated by hardening, deep freezing and tempering to RC 55–60. To form the channel 320 in the valve seat 30, a laser drilling process is preferred, although those skilled in the art will recognize that other, suitable methods can be used.

Figure 4:
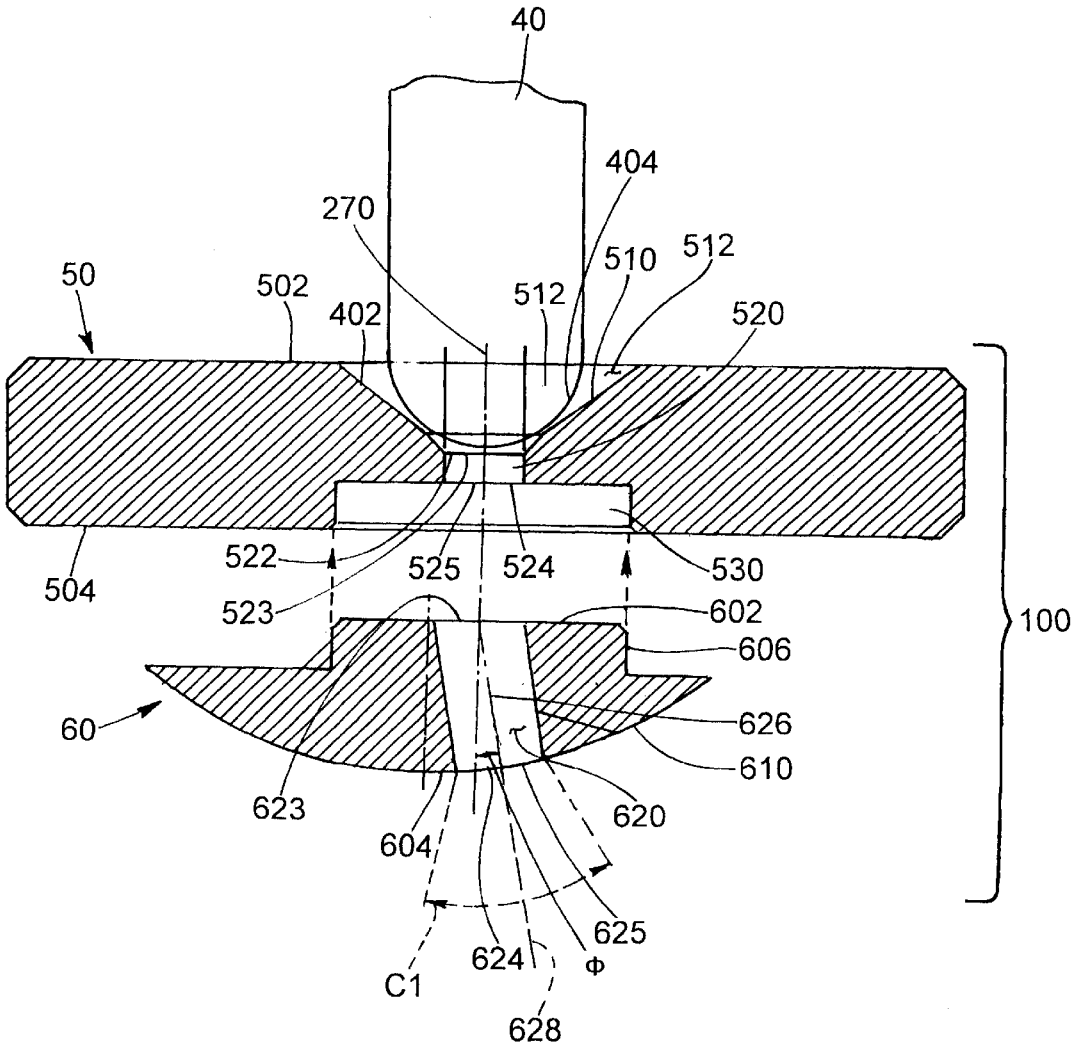
FIG. 4 is a side view, in section, of a valve seat according to a second embodiment of the present invention.

In a second embodiment, shown in FIG. 4, the one-piece valve seat 30 of the first embodiment can be replaced by a two-piece valve assembly 100 comprising a valve seat 50 and a first bent stream insert 60, with the longitudinal axis 270 extending therethrough. The valve seat 50 includes an upstream end 502, a downstream end 504 and a beveled surface 510 for seating the sealing surface 402 on the downstream end 404 of the needle 40. The beveled surface 510 also forms a transition cone 512, which directs fuel into a channel 520 which extends between the transition cone 512 and the downstream end 504 along the longitudinal axis 270. An upstream end 522 of the channel 520 includes a seat entrance orifice 523 and a downstream end 524 includes a seat exit orifice 525, with both the seat entrance orifice 523 and the seat exit orifice 525 being on the longitudinal axis 270. The valve seat 50 also includes a recessed opening or enlarged bore 530 downstream of the seat exit orifice 525 along the longitudinal axis 270 for accepting and retaining an insert projection 606 of the insert 60 in the bore 530 as will be discussed later herein. The bore 530 is larger than the seat exit orifice 525 so that the insert 60 can be inserted into the bore 530 without restricting flow from the seat exit orifice 525.

An upstream end 602 of the insert 60 includes an insert projection 606 which is adapted to be retained in the bore 530. A downstream end 604 of the insert 60 includes a spherical portion 610. An insert channel 620 having an insert entrance orifice 623 and an insert exit orifice 625 extends along a channel axis 626 through the projection 60, between the insert entrance orifice 623 in the upstream end 602 and the insert exit orifice 625 in the downstream end 604.

The insert entrance orifice 623 of the channel 620 is generally concentrically aligned with the transition cone 512 and the longitudinal axis 270 so that the insert entrance orifice 623 at the upstream end 622 of the channel 620 is fluidly connected to the seat exit orifice 525 in the seat 50. However, the insert exit orifice 625 is offset from the longitudinal axis 270, forming the channel 620 generally oblique to the longitudinal axis 270. As shown in FIG. 4, the channel axis 626 is at an angle Φ of approximately 10° oblique to the longitudinal axis 270, although those skilled in the art will recognize that the channel 620 can be at an angle less than 10° or up to 30° with respect to the longitudinal axis 270.

Fuel exiting from the insert exit orifice 625 forms a generally symmetric right circular cone-shaped spray C1, which exits the insert 60 at along a cone axis 628 which is generally co-linear with the channel axis 626, as shown in FIG. 4.

To construct the valve seat assembly 100, the projection 606 of the insert 60 is inserted into the enlarged bore 530 in the seat 50. Preferably, the seat 50 and the insert 60 are laser welded together, although those skilled in the art will recognize that the seat 50 and the insert 60 can be connected by other means, including press fit.

The seat 50 and insert 60, when the projection 606 of the insert 60 is inserted into the enlarged bore 530 in the seat 50, operates in the same manner as the first embodiment valve seat 30 described above. A benefit of the second embodiment over the first embodiment is that, with a separate seat 50 and insert 60, different materials can be used as desired. Preferably, the seat 50 is constructed from 440C stainless steel and the insert in constructed from 304 stainless steel, although those skilled in the art will recognize that the seat 50 and the insert 60 can be constructed of other materials, including but not limited to Fecralloy (iron-chrome-aluminum alloy) or ceramic material to reduce injector deposits. Additionally, the two-piece design allows the seat 50 to be a permanent part of the injector 10, but allows for a second insert constructed from a different material and/or having a different pre-determined angle Φ to be substituted for the first insert 60 for different applications or requirements. Further, the two-piece assembly 100 also allows for more simplicity in the assembly process since the insert 60 can be inserted into the seat 50 at the end of the assembly line, minimizing the need for tooling changes, and an insert 60 having a particular pre-determined angle D can be used, depending upon customer needs.

It will be appreciated by those skilled in the art that changes could be made to the embodiments described above without departing from the broad inventive concept thereof It is understood, therefore, that this invention is not limited to the particular embodiments disclosed, but it is intended to cover modifications within the spirit and scope of the present invention as defined by the appended claims.

What is claimed is:

1. An injector, the injector comprising:

a valve seat including:

a longitudinal axis extending therethrough;

an upstream end having a seat entrance orifice on the longitudinal axis;

a downstream end having a seat exit orifice on the longitudinal axis;

a seat channel extending between the seat entrance orifice and the seat exit orifice along the longitudinal axis; and a recessed opening downstream of the seat exit orifice along the longitudinal axis, the recessed opening being larger than the seat exit orifice; and a first bent stream insert including:

an upstream insert end having an insert entrance orifice;

a downstream insert end, the downstream insert end includes a spherical portion, the insert exit orifice being located in the spherical portion;

a channel axis extending therethrough;

an insert channel having an insert exit orifice at the downstream insert end, the insert channel having a channel axis oblique to the longitudinal axis; and an insert projection extending from the upstream end, the insert projection being adapted to be retained in the recessed opening, the seat exit orifice being in fluid communication with the insert entrance orifice, the insert exit orifice discharging a cone-shaped spray having a spray axis co-linear with the longitudinal axis.

2. The injector according to claim 1, wherein the outlet orifice has a circular cross-section normal to the outlet orifice.

3. The valve seat according to claim 1, wherein the insert exit orifice is circular.

4. The valve seat according to claim 1, wherein the angle is between zero and thirty degrees.

5. The valve seat according to claim 1, wherein the cone-shaped spray is a right circular cone.

6. A valve seat assembly for a fuel injector comprising:

a valve seat including:

a longitudinal axis extending therethrough;

an upstream end having a seat entrance orifice on the longitudinal axis;

a downstream end having a seat exit orifice on the longitudinal axis;

a seat channel extending between the seat entrance orifice and the seat exit orifice along the longitudinal axis; and a recessed opening downstream of the seat exit orifice along the longitudinal axis, the recessed opening being larger than the seat exit orifice; and a first bent stream insert including:

an upstream insert end having an insert entrance orifice;

a downstream insert end, the downstream insert end includes a spherical portion, the insert exit orifice being located in the spherical portion;

a channel axis extending therethrough;

an insert channel having an insert exit orifice at the downstream insert end, the insert exit orifice having a channel axis oblique to the longitudinal axis; and an insert projection extending from the upstream end, the insert projection being adapted to be retained in the recessed opening, the seat exit orifice being in fluid communication with the insert entrance orifice, the channel axis being at a first angle oblique to the seat axis.

7. The valve seat according to claim 6, wherein fuel exiting the insert exit orifice forms a symmetric cone-shaped spray having a spray axis co-linear with the channel axis.

8. The valve seat according to claim 7, wherein the cone-shaped spray is a right circular cone.

9. The valve seat according to claim 6, wherein the insert entrance orifice is circular.

10. The valve seat according to claim 6, wherein the insert exit orifice is circular.

11. The valve seat according to claim 6, wherein the insert exit orifice is circular.

12. The valve seat according to claim 6, wherein the first angle is between zero and thirty degrees.

13. A valve seat assembly for a fuel injector comprising:

a valve seat including:

a longitudinal axis extending therethrough;

an upstream end having a seat entrance orifice on the longitudinal axis;

a downstream end having a seat exit orifice on the longitudinal axis;

a seat channel extending between the seat entrance orifice and the seat exit orifice along the longitudinal axis; and a recessed opening downstream of the seat exit orifice along the longitudinal axis, the recessed opening being larger than the seat exit orifice; and a first bent stream insert including:

an upstream insert end having an insert entrance orifice;

a downstream insert end;

a channel axis extending therethrough;

an insert channel having an insert exit orifice at the downstream insert end, the insert exit orifice having a channel axis oblique to the longitudinal axis; and an insert projection extending from the upstream end, the insert projection being adapted to be retained in the recessed opening, the seat exit orifice being in fluid communication with the insert entrance orifice, the first bent stream insert substituted with a second bent stream insert having a second channel axis at a second angle oblique to the longitudinal axis.

14. The valve seat according to claim 13, wherein the first bent stream insert is constructed from a first material and the second bent stream insert is constructed from a second material.

15. A method of generating a cone-shaped bent spray from a fuel injector comprising the steps of:

directing fuel into an entrance orifice in a valve seat, the entrance orifice being along a longitudinal axis of the fuel injector;

directing the fuel from the entrance orifice, through a channel in the valve seat, to an exit orifice, the channel being along a channel axis at an angle oblique to the longitudinal axis; and discharging the fuel from the exit orifice through an insert to an insert exit orifice located on a spherical portion of the insert, the fuel forming a cone-shaped spray having a spray axis colinear with the channel axis.

16. The method according to claim 15, wherein the entrance orifice is circular.

17. The method according to claim 15, wherein the exit orifice is circular.

18. The method according to claim 15, wherein the angle is between zero and thirty degrees.

19. The method according to claim 15, wherein the cone-shaped spray is a right circular cone.

20. A method of changing a fuel spray angle in a fuel injector comprising the step of substituting the first bent stream insert from a discharge end of a fuel injector, the first bent stream insert having a first spray angle, for a second bent stream insert into the discharge end of the fuel injector, the second bent stream insert having a second spray angle.

21. The method according to claim 20, wherein the first bent stream insert is constructed from a first material and the second bent stream insert is constructed from a second material.

22. A method of providing multiple bent sprays from a single injector assembly comprising the steps of:

providing an injector having a discharge end, the discharge end being adapted to receive one of a plurality of inserts, each insert having a different pre-determined angle of discharge;

selecting an insert with a pre-determined angle of discharge; and fixedly inserting the insert into the discharge end of the injector.

* * * * *